US005187682A

United States Patent [19]

Kimura

[11] Patent Number: 5,187,682

[45] Date of Patent: Feb. 16, 1993

[54] FOUR QUADRANT ANALOG MULTIPLIER CIRCUIT OF FLOATING INPUT TYPE

[75] Inventor: Katsuji Kimura, Tokyo, Japan

[73] Assignee: NEC Corporation, Japan

[21] Appl. No.: 865,073

[22] Filed: Apr. 8, 1992

[30] Foreign Application Priority Data

Apr. 8, 1991 [JP] Japan ..... 3-73462

[51] Int. Cl.[5] ..... G06G 7/164

[52] U.S. Cl. ..... 364/841; 307/498; 328/160

[58] Field of Search ..... 364/841; 307/498; 328/160

[56] References Cited

U.S. PATENT DOCUMENTS

| | | | |
|---|---|---|---|
| 3,689,752 | 9/1972 | Gilbert | 364/841 |
| 3,838,262 | 9/1974 | Van de Plassche | 364/841 |
| 4,978,873 | 12/1990 | Shoemaker | 364/841 X |
| 5,115,409 | 5/1992 | Stepp | 364/841 |

FOREIGN PATENT DOCUMENTS

| | | | |
|---|---|---|---|
| 459513 | 12/1991 | European Pat. Off. | 364/841 |
| 3-210683 | 9/1991 | Japan | 364/841 |

*Primary Examiner*—Tan V. Mai

*Attorney, Agent, or Firm*—Laff, Whitesel, Conte & Saret

[57] ABSTRACT

A four quadrant analog multiplier circuit including first to third squaring circuits 1 to 3 each of which is composed of first and second differential circuits each of which is formed of first and second metal-oxide semiconductor (MOS) transistors $M_1$ and $M_2$, $M_3$ and $M_4$, $M_5$ and $M_6$, $M_7$ and $M_8$, $M_9$ and $M_{10}$, and $M_{11}$ and $M_{12}$. A gate width-to-length ratio $W_2/L_2$ of the second MOS transistor $M_2$ is larger than a gate width-to-length ratio $W_1/L_1$ of the first MOS transistor $M_1$. A gate of the first MOS transistor $M_1$, $M_5$ and $M_9$ of each first differential circuit is connected to a gate of the second MOS transistor $M_4$, $M_8$ and $M_{12}$ of the corresponding second differential circuit. A gate of the second MOS transistor $M_2$, $M_6$ and $M_{10}$ of each first differential circuit is connected to a gate of the first MOS transistor $M_3$, $M_7$ and $M_{11}$ of the corresponding second differential circuit. The gates of the MOS transistors $M_1$ and $M_9$ are connected in common to receive a first input signal $V_1$, and the gates of the MOS transistors $M_5$ and $M_{11}$ are connected in common to receive a second input signal $V_1$. Drains of the MOS transistors $M_1$, $M_3$, $M_5$, $M_7$, $M_{10}$, and $M_{12}$ are connected in common to a first output current terminal, and drains of the MOS transistors $M_2$, $M_4$, $M_6$, $M_8$, $M_9$, and $M_{11}$ are connected in common to a second output current terminal. A differential current between the first and second output current terminals is indicative of a product of the input signals $V_1$ and $V_2$.

5 Claims, 3 Drawing Sheets

FOUR QUADRANT ANALOG MULTIPLIER CIRCUIT OF FLOATING INPUT TYPE

BACKGROUND OF THE INVENTION

1. Field of the Invention

The present invention relates to an analog multiplier circuit, and more specifically to a high precision four quadrant analog multiplier circuit of a so-called floating input type, which can be effectively used particularly for modulation and demodulation of an analog signal.

2. Description of Related Art

Known conventional analog multiplier circuits include a Gilbert multiplier circuit composed of only bipolar transistors, a MOS multiplier circuit formed by substituting MOS transistors for the bipolar transistors of the Gilbert multiplier circuit, and a CMOS multiplier circuit formed by constituting the Gilbert multiplier circuit by CMOS transistor circuits.

In the Gilbert multiplier circuit, when the magnitude of each of two input signal voltages $V_1$ and $V_2$ is extremely smaller than 2 $V_T$ (where $V_T=kT/q$, K: Boltzmann's constant, T: absolute temperature, q: electric charge of unit electron), an output current is substantially in proportion to $V_1 \cdot V_2$. Namely, when each of the input signals is a small signal, the Gilbert circuit functions as the multiplier. In addition, each of the input signals must be applied in the formed of a differential signal Similarly, the MOS multiplier circuit functions as a multiplier when a pair of input signals are small. In addition, this MOS multiplier circuit is disadvantageous in that a linear operation range for one of the input signals is smaller than that for the other input signal. Furthermore, the CMOS multiplier circuit also has only a narrow input signal range which can ensure a good linear operation. In each of the MOS multiplier circuit and the CMOS multiplier circuit, furthermore, each of the input signals must also be applied in the form of a differential signal.

As mentioned above, the conventional multiplier circuits have been disadvantageous in that the dynamic range is narrow and each input signals must also be applied in the formed of a differential signal.

SUMMARY OF THE INVENTION

Accordingly, it is an object of the present invention to provide an analog multiplier circuit which has overcome the above mentioned defect of the conventional one.

Another object of the present invention is to provide a four quadrant analog multiplier circuit having a high degree of precision and of the so-called floating input type allowing that each input signal can be applied either in the form of a differential signal or in a floating input mode.

The above and other objects of the present invention are achieved in accordance with the present invention by a four quadrant analog multiplier circuit including a first squaring circuit receiving a first input signal for squaring the first input signal, a second squaring circuit receiving a second input signal for squaring the second input signal, a third squaring circuit receiving the first and second input signals for squaring a difference between the first and second inputs, and an addition circuit, coupled to the first to third squaring circuits, for subtracting an output of the third squaring circuit from a sum of outputs of the first and second squaring circuits, each of the first to third squaring circuits being composed of first and second differential circuits each of which is formed of first and second MOS transistors having their sources connected in common to a constant current source. A gate width-to-length ratio of the second MOS transistor is larger than a gate width-to-length ratio of the first MOS transistor. A gate of the first MOS transistor of the first differential circuit is connected to a gate of the second MOS transistor of the second differential circuit, and a gate of the second MOS transistor of the first differential circuit is connected to a gate of the first MOS transistor of the second differential circuit. A first input terminal for receiving the first input signal is connected to a gate of the first MOS transistor of the first differential circuit of each of the first and third squaring circuits, and a second input terminal for receiving the second input signal is connected to a gate of the first MOS transistor of the first differential circuit of the second squaring circuit and a gate of the first MOS transistor of the second differential circuit of the third squaring circuit. A common input terminal is connected to the gate of the second MOS transistor of the first differential circuit of each of the first and third squaring circuits. The addition circuit is formed by such a connection that a drain of the first MOS transistor of each of the first and second differential circuits of each of the first and second squaring circuits is connected in common to a drain of the second MOS transistor of each of the first and second differential circuits of the third squaring circuits and to a first current terminal, and a drain of the second MOS transistor of each of the first and second differential circuits of each of the first and second squaring circuits is connected in common to a drain of the first MOS transistor of each of the first and second differential circuits of the third squaring circuits and to a second current terminal.

The above and other objects, features and advantages of the present invention will be apparent from the following description of preferred embodiments of the invention with reference to the accompanying drawings.

BRIEF DESCRIPTION OF THE DRAWINGS

FIG. 2 is a block diagram illustrating an operation of the multiplier circuit shown in FIG. 1; and.

FIG. 3 is a graph illustrating an operation characteristics of the multiplier circuit shown in FIG. 1; and.

DESCRIPTION OF THE PREFERRED EMBODIMENTS

Figure 1:
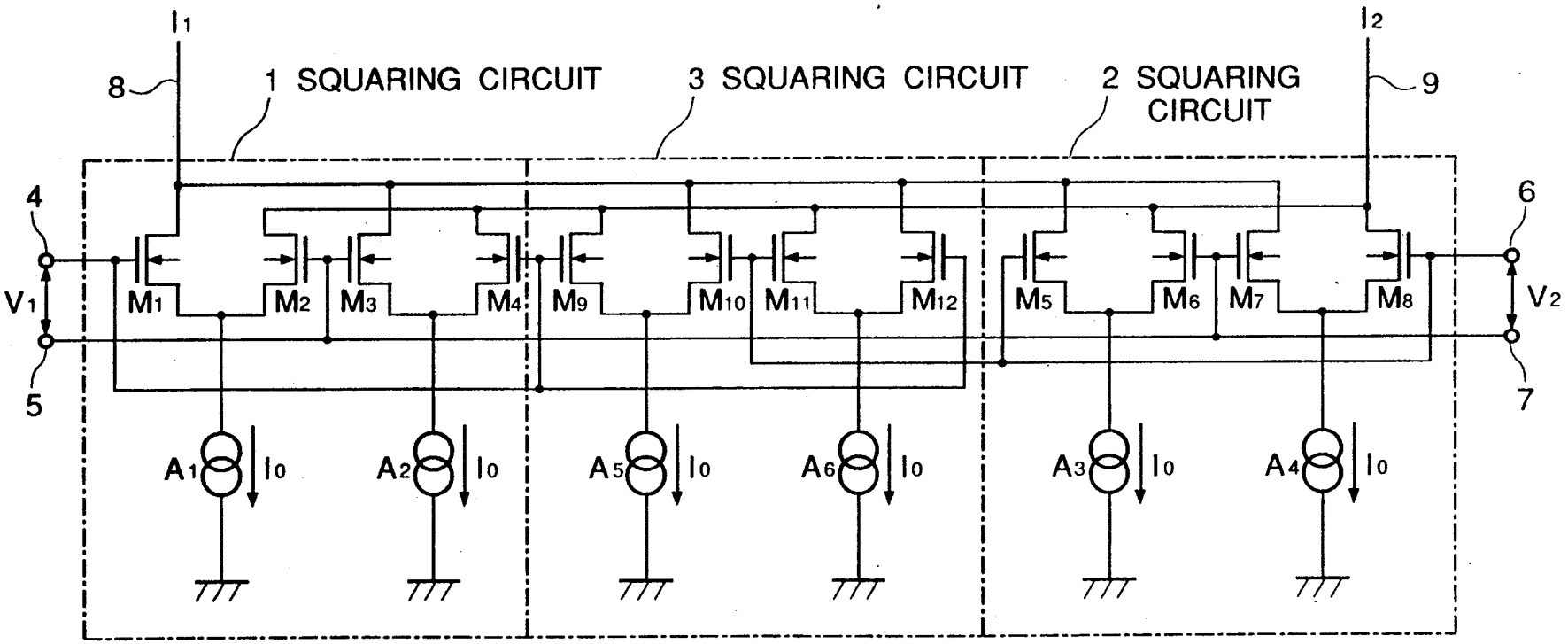
FIG. 1 is a circuit diagram of an embodiment of the multiplier circuit in accordance with the present invention.

Referring to FIG. 1, there is shown a circuit diagram of an embodiment of the four quadrant analog multiplier circuit in accordance with the present invention.

The shown multiplier circuit comprises a first squaring circuit 1 formed of MOS transistors M1 to M4, a second squaring circuit 2 formed of MOS transistors M5 to M8 and a third squaring circuit 3 formed of MOS transistors M9 to M12.

In the first squaring circuit 1, a first differential circuit is formed of the MOS transistors M1 and M2 having their sources connected in common to a constant current source A1 of a constant current $I_0$, and a second differential circuit is formed of the MOS transistors M3 and M4 having their sources connected in common to a constant current source A2 of a constant current $I_0$. A gate of the MOS transistor M1 of the first differential circuit is connected to a gate of the MOS transistor M4 of the second differential circuit, and a gate of the MOS transistor M2 of the first differential circuit is connected to a gate of the MOS transistor M3 of the second differential circuit.

In the second squaring circuit 2, a first differential circuit is formed of the MOS transistors M5 and M6 having their sources connected in common to a constant current source A3 of a constant current $I_0$, and a second differential circuit is formed of the MOS transistors M7 and M8 having their sources connected in common to a constant current source A4 of a constant current $I_0$. A gate of the MOS transistor M5 of the first differential circuit is connected to a gate of the MOS transistor M8 of the second differential circuit, and a gate of the MOS transistor M6 of the first differential circuit is connected to a gate of the MOS transistor M7 of the second differential circuit.

In the third squaring circuit 3, a first differential circuit is formed of the MOS transistors M9 and M10 having their sources connected in common to a constant current source A5 of a constant current $I_0$, and a second differential circuit is formed of the MOS transistors M11 and M12 having their sources connected in common to a constant current source A6 of a constant current $I_0$. A gate of the MOS transistor M9 of the first differential circuit is connected to a gate of the MOS transistor M12 of the second differential circuit, and a gate of the MOS transistor M10 of the first differential circuit is connected to a gate of the MOS transistor M11 of the second differential circuit.

A first input signal $V_1$ is supplied between a first signal input terminal 4 and a first antiphase input terminal 5, and a second input signal $V_2$ is supplied between a second signal input terminal 6 and a second antiphase input terminal 7. The first signal input signal terminal 4 is connected to the gates of the MOS transistors M1 and M4 of the first squaring circuit 1 and also the gates of the MOS transistors M9 and M12 of the third squaring circuit 3. In addition, the second signal input terminal 6 is connected to the gates of the MOS transistors M5 and M8 of the second squaring circuit 2 and also the gates of the MOS transistors M10 and M11 of the third squaring circuit 3. the first antiphase input terminal 5 and the second antiphase input terminal 7 are connected to each other and also connected to the gates of the MOS transistors M2 and M3 of the first squaring circuit 1 and the gates of the MOS transistors M6 and M8 of the second squaring circuit 2.

Furthermore, drains of the MOS transistors M1 and M3 of the first squaring circuit 1, drains of the MOS transistors M5 and M7 of the second squaring circuit 2 and drains of the MOS transistors M10 and M12 of the third squaring circuit 3 are connected in common to an output current signal terminal 8 for an output current signal $I_1$. In addition, drains of the MOS transistors M2 and M4 of the first squaring circuit 1, drains of the MOS transistors M6 and M8 of the second squaring circuit 2 and drains of the MOS transistors M9 and M11 of the third squaring circuit 3 are connected in common to an output current signal terminal 9 for an output current signal $I_2$. This drain connection of the MOS transistors M1 to 12 constitutes a wired addition circuit.

With the above mentioned arrangement, the first input signal $V_1$ is supplied between the first signal input terminal 4 and the first antiphase input terminal 5, and the second input signal $V_2$ is supplied between the second signal input terminal 6 and the second antiphase input terminal 7. Therefore, each of the first and second input signals $V_1$ and $V_2$ can be applied in the form of a differential signal. However, since the first antiphase input terminal 5 and the second antiphase input terminal 7 are connected to each other, the first antiphase input terminal 5 and the second antiphase input terminal 7 can be grounded. In this case, the first and second input signals $V_1$ and $V_2$ are supplied to only the first and second signal input terminals 4 and 6, respectively, in the form of a single line signal (not in the form of a differential signal). This signal input type enabling the above mentioned two different signal input modes is called a "floating input type".

Figure 2:
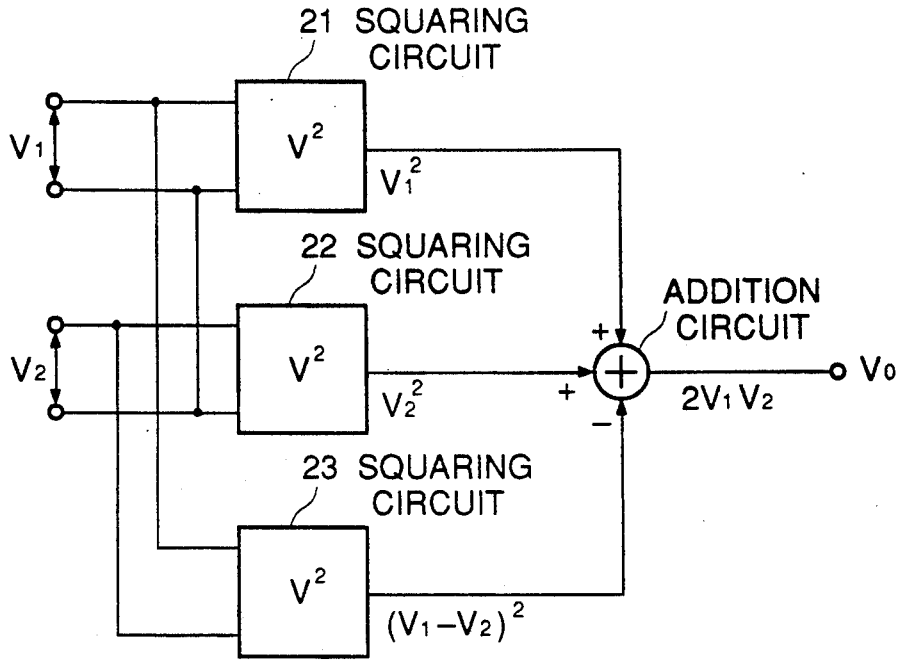

The function of the multiplier circuit shown in FIG. 1 can be shown by a function block diagram of FIG. 2. In FIG. 2, a squaring circuit 21 for squaring the input signal $V_1$ corresponds to the first squaring circuit 1 shown in FIG. 1, and a squaring circuit 22 for squaring the input signal $V_2$ corresponds to the second squaring circuit 2 shown in FIG. 1. In addition, a squaring circuit 23 for squaring a difference $(V_1-V_2)$ between the input signal $V_1$ and the input signal $V_2$ corresponds to the first squaring circuit 3 shown in FIG. 1. An addition circuit 24 coupled to respective outputs of the squaring circuits 21 to 23, adds the outputs of the squaring circuits 21 and 22 and subtracts the output of the squaring circuit 23 from the added outputs of the squaring circuits 21 and 22. This addition circuit 24 corresponds to the wired addition circuit constituted of the above mentioned drain connection of the MOS transistors M1 to 12 in FIG. 1. Ih other words, the addition circuit 24 is included in the first to third squaring circuits 1 to 3 shown in FIG. 1.

In the circuit shown in FIG. 2, if the input signals $V_1$ and $V_2$ are applied, an output signal Vo of the addition circuit 24 is expressed by the following equation.

$$V_1^2+V_2^2-(V_1-V_2)^2=2\,V_1V_2$$

Namely, a product $2\,V_1V_2$ of the input signals $V_1$ and $V_2$ can be obtained as a result of the multiplication of the input signals $V_1$ and $V_2$.

In the circuit shown in FIG. 1, a ratio W/L of a gate width W to a gate length L of the MOS transistors M1 to M12 is expressed by $W_1/L_1$ to $W_{12}/L_{12}$, respectively. The MOS transistors of each of the differential circuits of each of the three squaring circuits 1 to 3 are designed such that the ratio W/L of an odd-numbered MOS transistor is larger than the ratio W/L of an even-numbered MOS transistor $$\frac{W_2/L_2}{W_1/L_1}=\frac{W_4/L_4}{W_3/L_3}=\frac{W_6/L_6}{W_5/L_5}=\frac{W_8/L_8}{W_7/L_7}=\frac{W_{10}/L_{10}}{W_9/L_9}=\frac{W_{12}/L_{12}}{W_{11}/L_{11}}=k(>1) \quad (1)$$

$$\text{where } L_1=L_3=L_5=L_7=L_9=L_{11} \quad (2)$$

In addition, drain currents $I_{d1}$ to $I_{d4}$ of the MOS transistors M1 to M4 in the first squaring circuit 1 are expressed by the following equation.

$$I_{d1} = \alpha(V_{gs1} - V_t)^2 \quad (3)$$
$$I_{d2} = k\alpha(V_{gs2} - V_t)^2 \quad (4)$$
$$I_{d3} = \alpha(V_{gs3} - V_t)^2 \quad (5)$$
$$I_{d4} = k\alpha(V_{gs4} - V_t)^2 \quad (6)$$
$$\because \alpha = \mu_n \frac{COX}{2} \frac{W_1}{L_1} \quad (7)$$

where $\mu_n$ is a mobility of MOS transistor; COX is a gate capacitance per unit area; and $V_t$ is a threshold voltage.

In addition, the drain currents $I_{d1}$ to $I_{d4}$ and gate-source voltages; $V_{gs1}$ to $V_{gs4}$ of the MOS transistors M1 to M4 have the following relations, respectively.

$$I_{d1}+I_{d2}=I_0 \quad (8)$$
$$I_{d3}+I_{d4}=I_0 \quad (9)$$
$$V_{gs1}-V_{gs2}=V_{gs4}-V_{gs3}=V_1 \quad (10)$$

From the above mentioned equations, a difference $(I_{d1}-I_{d2})$ between the drain currents $I_{d1}$ and $I_{d2}$ of the MOS transistors M1 and M2, and a difference $(I_{d3}-I_{d4})$ between the drain currents $I_{d3}$ and $I_{d4}$ of the MOS transistors M3 and M4 are expressed as follows:

$$I_{d1} - I_{d2} = \frac{-\left(1-\frac{1}{k}\right)\left\{\left(1+\frac{1}{k}\right)I_0 - 2\alpha V_1^2\right\} + 4\alpha V_1 \frac{1}{\sqrt{k}}\sqrt{\left(1+\frac{1}{k}\right)\frac{I_0}{\alpha} - V_1^2}}{\left(1+\frac{1}{k}\right)^2} \quad (11)$$

$$I_{d3} - I_{d4} = \frac{-\left(1-\frac{1}{k}\right)\left\{\left(1+\frac{1}{k}\right)I_0 - 2\alpha V_1^2\right\} + 4\alpha V_1 \frac{1}{\sqrt{k}}\sqrt{\left(1+\frac{1}{k}\right)\frac{I_0}{\alpha} - V_1^2}}{\left(1+\frac{1}{k}\right)^2} \quad (12)$$

Accordingly, a differential output current $\Delta I_1$ of the squaring circuit 1 is obtained from the following equation:

$$\Delta I_1 = (I_{d1} + I_{d3}) - (I_{d2} + I_{d4}) = (I_{d1} - I_{d2}) + (I_{d3} - I_{d4}) = -\frac{2\left(1-\frac{1}{k}\right)\left\{\left(1+\frac{1}{k}\right)I_0 - 2\alpha V_1^2\right\}}{\left(1+\frac{1}{k}\right)^2} \quad (13)$$

As will be apparent from the equation (13), the differential output current $\Delta I_1$ of the squaring circuit 1 is in proportion to a square of the input signal $V_1$. Namely, the circuit 1 functions as a squaring circuit.

Similarly, deferential output currents $\Delta I_1$ and $\Delta I_1$ of the squaring circuits 2 and 3 are expressed as follows:

$$\Delta I_2 = -\frac{2\left(1-\frac{1}{k}\right)\left\{\left(1+\frac{1}{k}\right)I_0 - 2\alpha V_2^2\right\}}{\left(1+\frac{1}{k}\right)^2} \quad (14)$$

-continued $$\Delta I_3 = -\frac{2\left(1-\frac{1}{k}\right)\left\{\left(1+\frac{1}{k}\right)I_0 - 2\alpha(V_1 - V_2)^2\right\}}{\left(1+\frac{1}{k}\right)^2} \quad (15)$$

Therefore, an overall differential current $\Delta I$ of the multiplier circuit shown in FIG. 1 is expressed as follows:

$$\Delta I = \Delta I_1 + \Delta I_2 - \Delta I_3 = -\frac{2\left(1-\frac{1}{k}\right)\left\{\left(1+\frac{1}{k}\right)I_0 + 4\alpha V_1 V_2\right\}}{\left(1+\frac{1}{k}\right)^2} \quad (16)$$

Accordingly, as will be apparent from the equation (16), the differential current $\Delta I$ of the multiplier circuit shown in FIG. 1 can be expressed by a product of the input signals $V_1$ and $V_2$, and therefore, functions as a multiplier circuit.

In addition, if the constant current value of each of the constant current sources A5 and A6 of the squaring circuits 3 is set to be $2I_0$, the item of $I_0$ in the equation (16) is cancelled. In this case, the differential output current $\Delta Ia$ can be obtained from the following equations:

$$\Delta I_a = \Delta I_1 + \Delta I_2 - \Delta I_{3a} = -\frac{8\left(1-\frac{1}{k}\right)\alpha V_1 V_2}{\left(1+\frac{1}{k}\right)^2} \quad (17)$$

$$= -8\frac{\left(1-\frac{1}{k}\right)}{\left(1+\frac{1}{k}\right)^2}\mu_n \frac{COX}{2} \cdot \frac{W_1}{L_1} V_1 V_2 \quad (18)$$

$$\because \Delta I_{3a} = -\frac{2\left(1-\frac{1}{k}\right)\left\{\left(1+\frac{1}{k}\right)2I_0 - 2\alpha(V_1 - V_2)^2\right\}}{\left(1+\frac{1}{k}\right)^2}$$

The differential output current ΔIa corresponds to a difference between the output current $I_1$ and the output current $I_2$.

Figure 4:
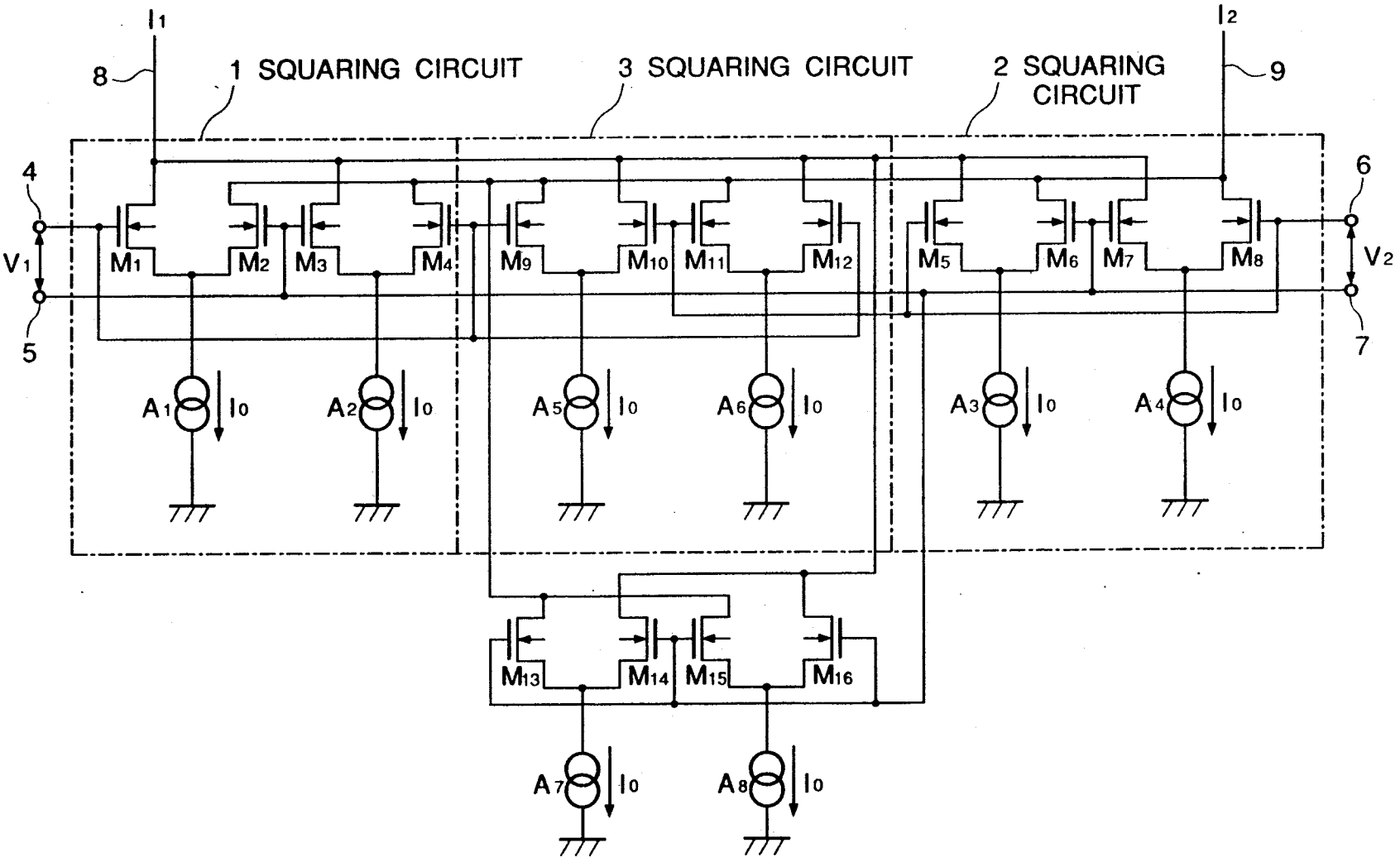
FIG. 4 is a circuit diagram of a modification of the multiplier circuit shown in FIG. 1.

A similar effect can be obtained by adding a no-input squaring circuit which has the same construction as that of the squaring circuits 1 and 2 and in which a gate of each of MOS transistors M13 to 16 are connected to the common input line of the first and second antiphase input terminals 5 and 7, as shown in FIG. 4. In this case, the constant current sources A1 to A8 has the same constant current capacity.

As seen from the equation (18), the differential output current ΔIa of the multiplier circuit is determined by only the product of the input signals $V_1$ and $V_2$ and a proportion constant, which is also determined by physical property and mask size of the MOS transistors.

In addition and more importantly, no approximation is made in the process of calculation for deriving the equations (16) to (18). Therefore, the precision of the multiplication operation characteristics of the disclosed multiplier circuit is considered to be governed by a proportion precision of circuit elements, namely, the MOS transistors. Accordingly, if the disclosed multiplier circuit is formed on a semiconductor integration circuit, it is possible to obtain a multiplier circuit having a high precision as an inherent nature.

Figure 3:
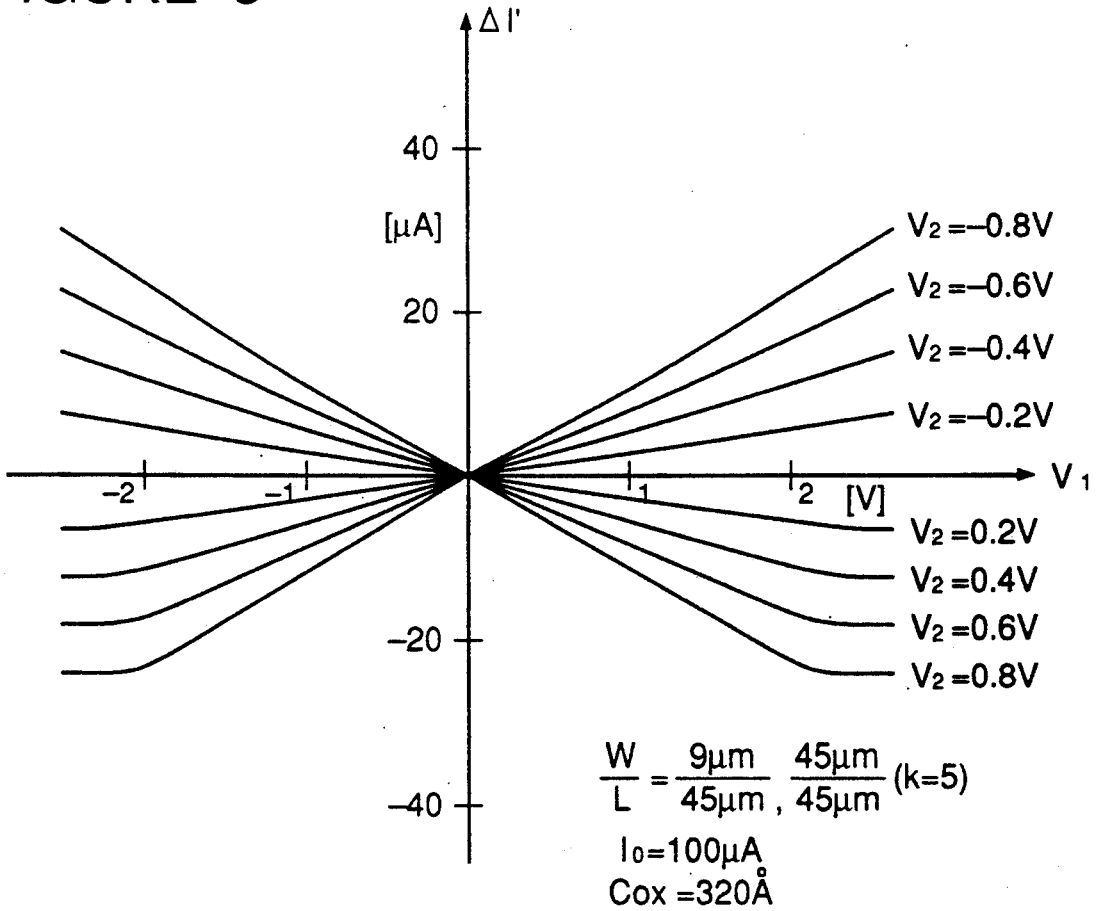

FIG. 3 illustrate a result of a simulation of the operation property of the disclosed multiplier circuit.

In the disclosed multiplier circuit, since each squaring circuit is composed of a pair of differential circuits each formed of first and second MOS transistors having a relation in which a gate width-to-length ratio of the second MOS transistor is larger than a gate width-to-length ratio of the first MOS transistor, the circuit can effectively utilize the voltage-current characteristics of MOS transistors having a square characteristics. Thus, in an input signal range capable of ensuring the good linearity, the multiplier circuit can operates in the floating input type or system.

The invention has thus been shown and described with reference to the specific embodiments. However, it should be noted that the present invention is in no way limited to the details of the illustrated structures but changes and modifications may be made within the scope of the appended claims.

I claim:

1. A four quadrant analog multiplier circuit including a first squaring circuit receiving a first input signal for squaring said first input signal, a second squaring circuit receiving a second input signal for squaring said second input signal, a third squaring circuit receiving said first and second input signals for squaring a difference between said first and second inputs, and an addition circuit, coupled to said first to third squaring circuits, for subtracting an output of said third squaring circuit from a sum of outputs of said first and second squaring circuits, each of said first to third squaring circuits being composed of first and second differential circuits each of which is formed of first and second MOS transistors having their sources connected in common to a constant current source, a gate width-to-length ratio of said second MOS transistor being larger than a gate width-to-length ratio of said first MOS transistor, a gate of said first MOS transistor of said first differential circuit being connected to a gate of said second MOS transistor of said second differential circuit, a gate of said second MOS transistor of said first differential circuit being connected to a gate of said first MOS transistor of said second differential circuit, a first input terminal for receiving said first input signal being connected to a gate of said first MOS transistor of said first differential circuit of each of said first and third squaring circuits, a second input terminal for receiving said second input signal being connected to a gate of said first MOS transistor of said first differential circuit of said second squaring circuit and a gate of said first MOS transistor of said second differential circuit of said third squaring circuit, a common input terminal being connected to said gate of said second MOS transistor of said first differential circuit of each of said first and third squaring circuits, and said addition circuit being formed by such a connection that a drain of said first MOS transistor of each of said first and second differential circuits of each of said first and second squaring circuits is connected in common to a drain of said second MOS transistor of each of said first and second differential circuits of said third squaring circuits and to a first current terminal, and a drain of said second MOS transistor of each of said first and second differential circuits of each of said first and second squaring circuits is connected in common to a drain of said first MOS transistor of each of said first and second differential circuits of said third squaring circuits and to a second current terminal.

2. A four quadrant analog multiplier circuit claimed in claim 1 wherein said constant current source connected to each of said first and second differential circuits of each of said first and second squaring circuits has a first constant current capacity, and said constant current source connected to each of said first and second differential circuits of said third squaring circuit has a second constant current capacity which is a double of said first constant current capacity.

3. A four quadrant analog multiplier circuit claimed in claim 2 wherein said first and second differential circuit of all said first to third squaring circuits have the same proportion of said gate width-to-length ratio of said second MOS transistor to said gate width-to-length ratio of said first MOS transistor.

4. A four quadrant analog multiplier circuit claimed in claim 1 further including a fourth squaring circuit composed of first and second differential circuits each of which is formed of first and second MOS transistors having their sources connected in common to a constant current source having the same constant current capacity as that of said constant current source connected to each of said first and second differential circuits of each of said first to third squaring circuits, gates of said first and second MOS transistors of said first and second differential circuits of said fourth squaring circuit being connected in common to each other and to said common input terminal.

5. A four quadrant analog multiplier circuit claimed in claim 4 wherein said first and second differential circuits of all said first to fourth squaring circuits have the same proportion of said gate width-to-length ratio of said second MOS transistor to said gate width-to-length ratio of said first MOS transistor.

* * * * *